US007494237B1

(12) United States Patent
Cheung

(10) Patent No.: US 7,494,237 B1
(45) Date of Patent: Feb. 24, 2009

(54) MULTIPLE PROGRAMMED DIFFERENT SEQUENTIAL ILLUMINATION LIGHT SOURCES FOR FOOTWEAR

(76) Inventor: James D. Cheung, 5 Boxwood Way, Warren, NJ (US) 07059

( * ) Notice: Subject to any disclaimer, the term of this patent is extended or adjusted under 35 U.S.C. 154(b) by 0 days.

(21) Appl. No.: 11/613,894

(22) Filed: Dec. 20, 2006

(51) Int. Cl.
*F21V 33/00* (2006.01)

(52) U.S. Cl. ..... 362/103; 362/276; 362/800; 362/802; 362/251; 36/137; 315/76

(58) Field of Classification Search ..... None
See application file for complete search history.

(56) References Cited

U.S. PATENT DOCUMENTS 5,903,103 A * 5/1999 Garner ..... 315/76
6,764,193 B1 * 7/2004 Wei ..... 362/103
6,789,913 B2 * 9/2004 Wei ..... 362/103
2004/0160196 A1 * 8/2004 Wong ..... 315/291
2005/0183294 A1 * 8/2005 Guzman ..... 36/137
2005/0286248 A1 * 12/2005 Weng ..... 362/276
2007/0041193 A1 * 2/2007 Wong et al. ..... 362/276

* cited by examiner

*Primary Examiner*—Laura Tso
(74) *Attorney, Agent, or Firm*—Greenberg Traurig, LLP

(57) ABSTRACT

The present invention generally relates to a shoe having an incorporated light source. The light source includes a plurality of LEDs composed of several light-emitting chips of at least two different colors wherein the plurality of LEDs being used to generate light of various color. The light source further includes a trigger controller for generating a trigger signal when vibrated and a control IC for generating a drive signal to control a lighting duration of each of the plurality of LEDs to emit a plurality of desired different illumination sequences of at least 2 different colors. The drive signal is activated by the trigger signal and the manual switch selects the plurality of desired programmed different sequential illumination of light sources from at least two programmed flash sequences.

3 Claims, 5 Drawing Sheets

MULTIPLE PROGRAMMED DIFFERENT SEQUENTIAL ILLUMINATION LIGHT SOURCES FOR FOOTWEAR

BACKGROUND OF THE INVENTION

Conventionally, for aesthetic purposes, shoe bodies have been modified with regard to shape of the shoe or the color and pattern of the surface of the shoe. Another method of improving the aesthetics of shoes is to add lights and flashing devices to provide dynamic visual effects. U.S. Pat. No. 4,484,009 is one example of this light shoe technology. The lighted shoes technology typically includes the basic components of a one or more lights, a battery, sequential driver and switch.

BRIEF DESCRIPTION OF DRAWINGS

A more complete appreciation of the present invention and many of the attendant advantages thereof will be readily understood by reference to the following description was considered in connection with the accompanying drawings in which.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various embodiments and features thereof.

DETAILED DESCRIPTION OF THE EMBODIMENT OF THE INVENTION

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

In one embodiment, the present invention comprises a shoe having a plurality of programmed different sequential illumination of light sources. In yet another embodiment, a module comprises a light source, sequential driver and timer, power source, motion switch and selective switch.

In yet another embodiment, the wear selects the desired programmed different sequential illumination of light sources from at least two programmed flash sequences—e.g. "selective multi-flash." In a further embodiment, the present invention comprises a shoe having at least two programmed illumination or sequences that alternate at predetermined programmed illumination—e.g. "automatic multi-flash."

Examples of the plurality of programmed sequential illumination of light sources include, but are not limited to, a change of flash direction, change of light colors, and different combination of light flash, change of flash order of sequences, simultaneous illumination of multiple light source and/or change of flash speed. It is understood that the previous examples are merely are illustrative. Suitable power source include, but are not limited to, a 3V battery, a 1.5V battery, and/or a lithium battery.

Figure 1:
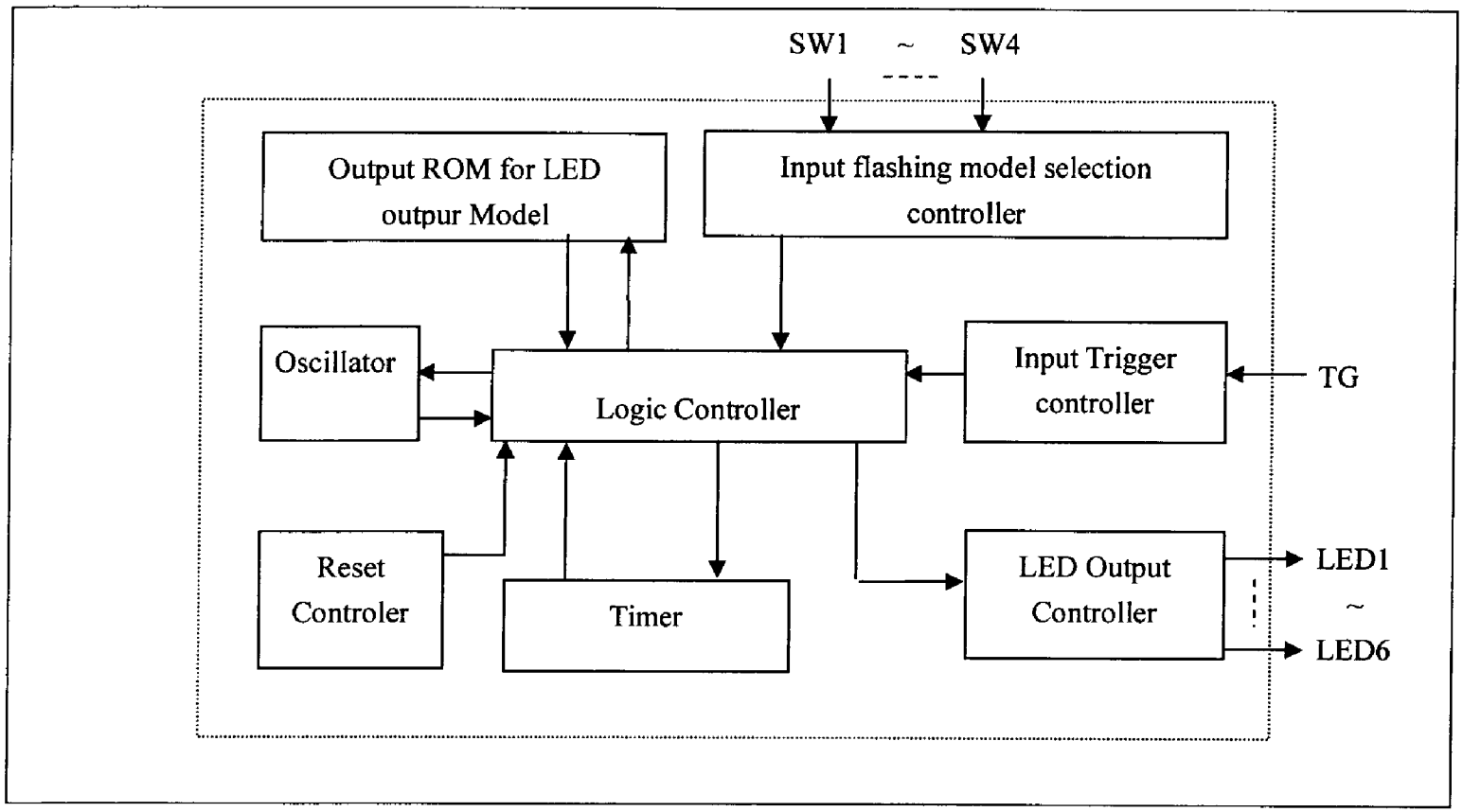
FIG. 1 is a block diagram of one embodiment of the present invention illustrating the automatic multiflash mode.

FIG. 1 is a block diagram illustrating one embodiment of the automatic multi-flash function of the present invention. As shown in FIG. 1, the control IC 10 is composed of oscillator 14, timer 16, input trigger controller 18, logic controller 12, reset controller 20, input flashing model selection controller 22 and LED output controller 24. As shown in FIG. 1, logic controller 10 receives input from input trigger controller 12 that is connected to TG and input flashing model selection controller 16 that is connected to SW1 and SW4. Logic controller 10 is associated with oscillator 20. Oscillator 20 and timer 16 are used to generate a work frequency. Input trigger controller 12 is electrically connected to TG. When TG is vibrated, input trigger controller 12 generates a trigger signal to logic controller 12. Logic controller 12 sends a signal to the LED output controller 24 that, in turn, sends a drive signal to LEDs. Input flashing model selection controller 22 has at least two programmed illumination or sequences that alternate at predetermined programmed illumination—e.g. "automatic multi-flash"—set by SW1—SW4. Logic controller 12 controls illumination of LED output controller 24 according to input flashing model selection controller 22.

Figure 2:
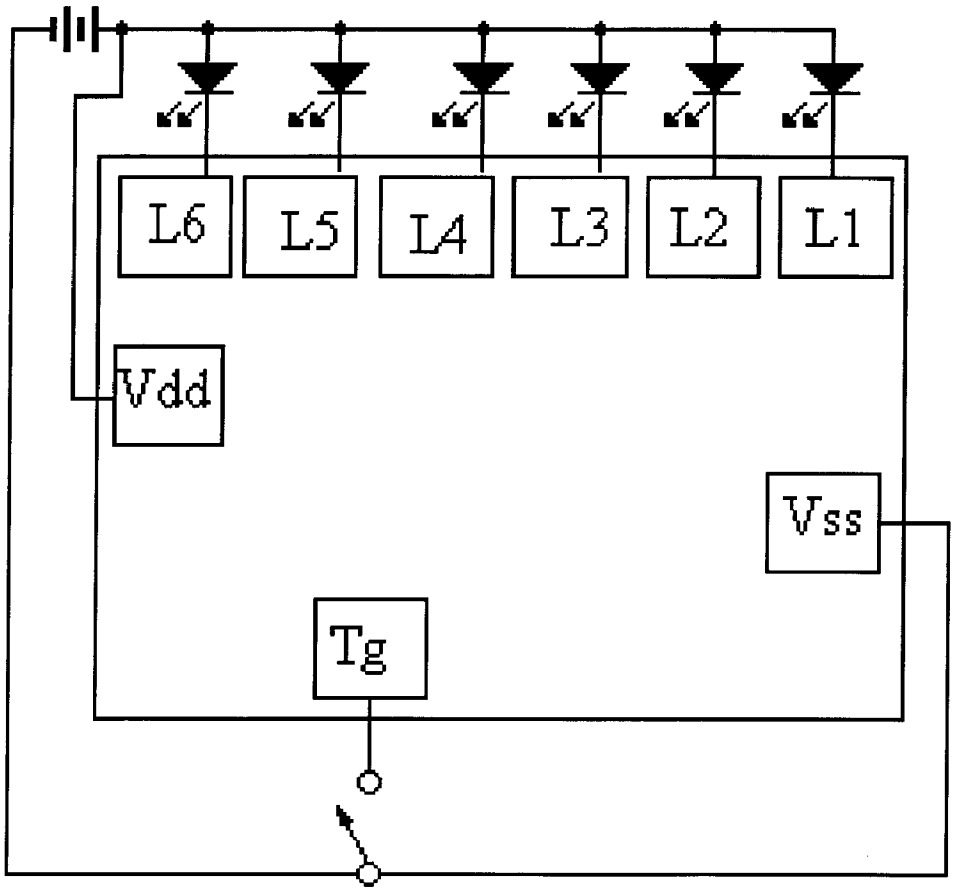
FIG. 2 is a circuit block diagram of one embodiment of the present invention illustrating the automatic multiflash mode.

FIG. 2 is the circuit diagram of FIG. 1. In this example, predetermined programmed illumination of six LEDs (i.e. L1-L6) are shown.

Figure 3:
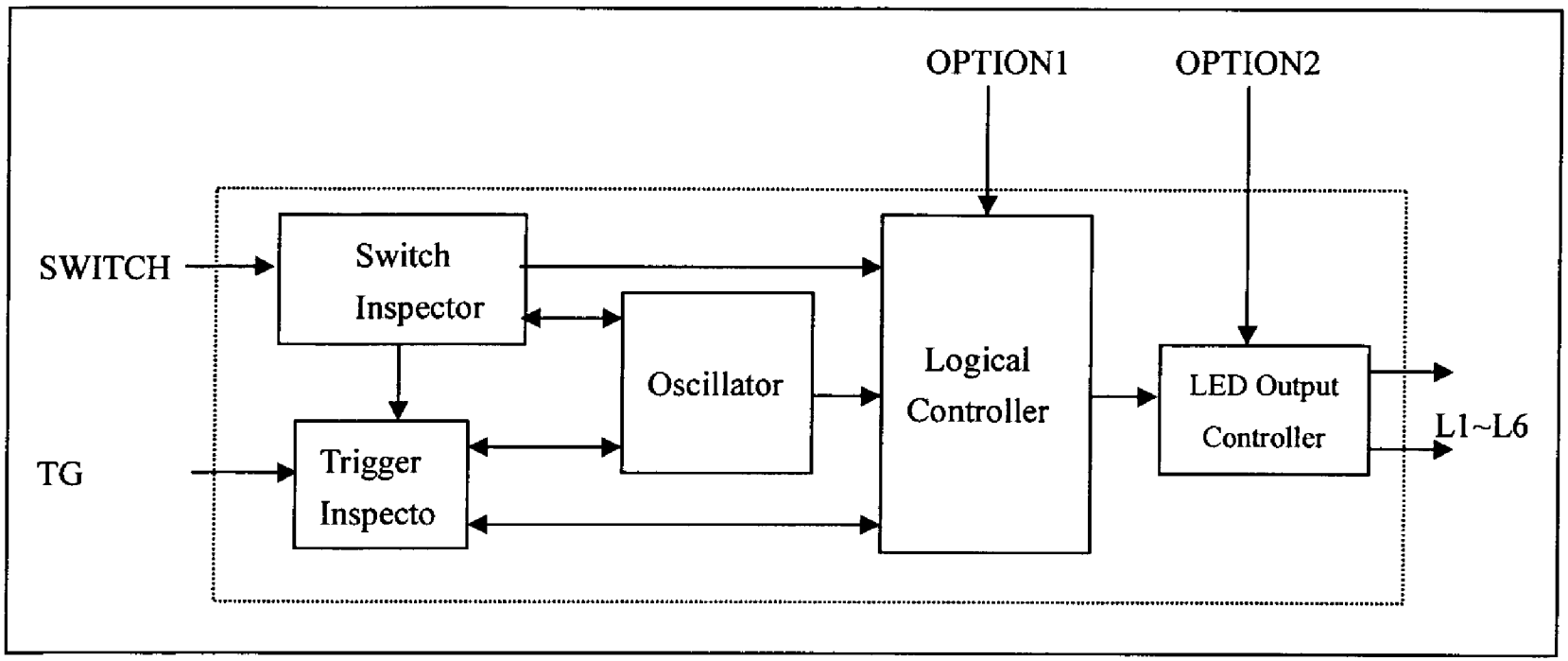
FIG. 3 is a block diagram of one embodiment of the present invention illustrating the selective multiflash mode.

FIG. 3 is a block diagram illustrating one embodiment of the "selective" multi-flash function of the present invention. As shown in FIG. 3, the control IC 100 is composed of oscillator 140, input trigger controller 180, switch controller 160, logic controller 120, and LED output controller 240. As shown in FIG. 3, logic controller 100 receives input from input trigger controller 120 that is connected to TG and switch 160 that is connected to switch. Logic controller 100 is associated with oscillator 200. Oscillator 200 is used to generate a work frequency. Input trigger controller 180 is electrically connected to TG. When TG is vibrated, input trigger controller 180 generates a trigger signal to logic controller 120. Logic controller 12 sends a signal to the LED output controller 240 that, in turn, sends a drive signal to LEDs. Switch sends a signal to switch 160 wear to select the desired programmed different sequential illumination of light sources from at least two programmed flash sequences—e.g. "selective multi-flash." Logic controller 120 controls illumination of LED output controller 240 according the desired programmed different sequential illumination of light sources from at least two programmed flash sequences.

Figure 4:
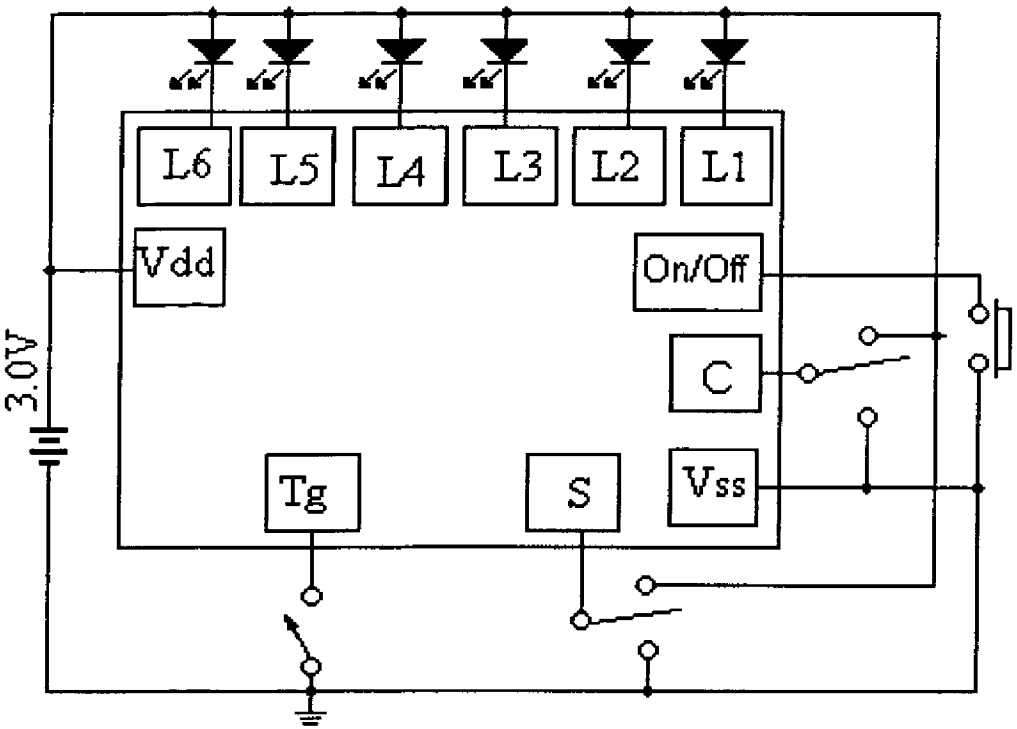
FIG. 4 is a circuit block diagram of one embodiment of the present invention illustrating the selective multiflash mode.

FIG. 4 is the circuit diagram of FIG. 3. In this example, the desired programmed different sequential illumination of light sources from at least two programmed flash sequences involve six LEDs (i.e. L1-L6) shown.

Figure 5:
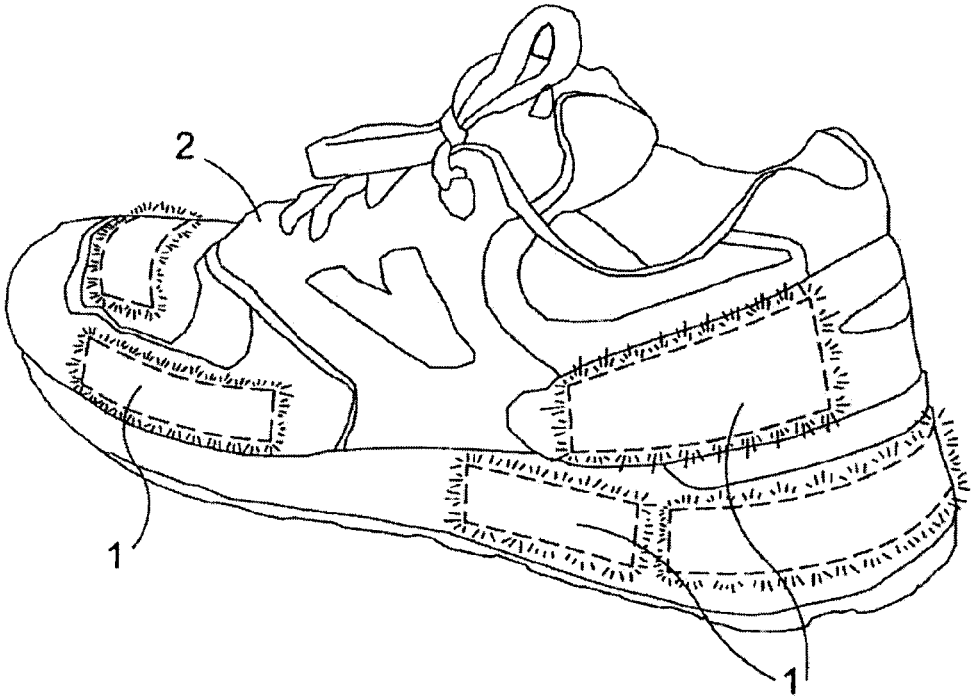
FIG. 5 is a perspective view of the present invention in use.

FIG. 5 is a perspective view of the present invention in use.

In one example, the shoe light device is installed in a shoe, and the LEDs are exposed on a visible portion outside the shoe. When a wearer wearing the shoe walks, the multiple LEDs radiates the desired programmed different sequential illumination of light sources in turn according to his/her steps. Therefore, when the wearer wearing the shoe walks, light in multiple color variations is displayed to enhance the fin of wearing the shoe and to create the desired effect.

In another example of the multi-flashing unit contained within the shoe, one or more conductive wires protrude from a substrate and extends out of a shell body. The other end of the conductive wires are connected to LEDs. A vibration switch and the control IC are disposed on the substrate. Each time an external force (e.g., vibration) is exerted on the shell body, the vibration switch triggers the control IC, which then generates a drive signal to make the LEDs emit the desired color variations in a flashing episode after receiving the trigger signal generated by the vibration switch.

The following are illustrative examples of the present invention. In this example, the wearer selects the desired illumination. In one example of the "selective multi-flash" mode, the wearer presses or activates a switch to select the desired illumination sequence from the plurality of programmed different sequential illumination of light sources. In yet another example, the selected illumination remains activated until the wearer makes another selection. In a further example, the choices of available illumination to the wearer may depend on marketability, economics, styling and fashion trends. As such, for example, the invention may keep the wearer interested and attention to make the choice of illumination that is fun, exciting and attention-grabbing.

In yet another example of the "automatic multi-flash" mode, an illumination sequence from the plurality of programmed different sequential illumination of light sources is changed after a set number of motion activations. For example, after a predetermined number of illumination that correlates to a specified number of motion activations, a different sequential illumination of light sources will occur. In yet another example, at least one subsequent motion activation and a corresponding sequential illumination of light sources may either return to the previous sequential illumination of light sources or to a different sequential illumination of light sources. The amount of programmed different sequential illumination of light sources or the amount of motion activations will depends on marketability, economics, styling and fashion trends.

In yet another embodiment, the light source can include one or more light sources. In a further embodiment, suitable light sources include, but are not limited to, incandescent bulbs, electroluminescent and/or light emitting diode (LED) or any combinations of this list. In yet another embodiment, the light sources may include color mixing, multiple single LEDs of the same color, mixed color LEDS having three original-color lighting chips (e.g. by mixing different colors of light, various combinations of light based on red, green and blue lighting chips) and/or various combinations of colors depending on the styling and creativity.

In anther embodiment, multiple LED ICs may be incorporated on at least one lens covering with the plurality of programmed different sequential illumination of light sources. In yet another embodiment, the combination of two or more different colors at various on and off time sequences that produces a blending of colors may be used. In one example, the multiple colors may be housed on a single lens covering or individual lens for each color or same color. In a further example, the position placement of various colors LED along with a unique simultaneous illumination of multiple light sources will result in blending of colors that is not produced on a single color LED.

Suitable desired programmed different sequential illumination of light sources from each programmed flash sequences may include, but are not limited, the following (or in combination): illumination variations of the color-mixing of the plurality of LED (e.g. color-mixing has of multiple colors—e.g. blue, red, white, orange and green) that flash in a specified color order; and/or a specified mixed ratio of multiple LED (e.g. 3 different color LED of 5:6:7).

Those skilled in the art will readily observe that numerous modification and alterations of the device may be made while retaining the teachings of the invention. Accordingly, the above disclosure should be construed as limited only by the metes and bounds of the appended claims.

What is claimed is:

1. A shoe having an incorporated light source comprising:

a) at least two arrays of LEDs, wherein a first and second arrays of LEDs are each composed of a plurality of light-emitting chips of at least two different colors wherein;

b) a power source for providing electricity for the at least two arrays of LEDs;

c) a trigger controller for generating a trigger signal, wherein the trigger controller includes a switch structure that is designed to be activated in response to motion and wherein the trigger controller is directly coupled to the first and second arrays of LEDs;

d) a control IC for generating a drive signal, wherein the control IC is directly coupled to the trigger signal to control a lighting duration of each of the at least two arrays of LEDs to emit a plurality of desired different illumination sequences and;

e) a manual switch, directly coupled to the trigger controller for selecting one of the plurality of desired programmed different sequential illumination of the second array of LEDs from at least two programmed flash sequences.

2. The shoe having an incorporated light source of claim 1 wherein the selected illumination remains activated until the another selection is made by the manual switch.

3. The shoe having an incorporated light source of claim 1 wherein the light sources include color mixing, multiple single LEDs of the same color, mixed color LEDs having at least 2 color lighting or various combinations of colors.

* * * * *